United States Patent [19]

Shumaker

[11] 4,344,734

[45] Aug. 17, 1982

[54] SELF-LEVELING BUCKET LINKAGE

[75] Inventor: John F. Shumaker, Mt. Pleasant, Iowa

[73] Assignee: J. I. Case Company, Racine, Wis.

[21] Appl. No.: 152,762

[22] Filed: May 23, 1980

[51] Int. Cl.[3] ..... E02F 3/70

[52] U.S. Cl. ..... 414/710; 414/714; 414/917

[58] Field of Search ..... 414/700, 706, 707, 710, 414/712, 714, 715, 716, 917

[56] References Cited

U.S. PATENT DOCUMENTS

| | | | |
|---|---|---|---|
| 2,820,555 | 1/1958 | Lessmann | 414/707 |
| 3,370,729 | 2/1968 | Clarke | 414/707 |
| 3,407,947 | 10/1968 | Valla | 414/708 X |
| 3,447,708 | 6/1969 | Steinkamp | 414/712 |
| 3,464,574 | 9/1969 | Campbell | 414/715 |
| 3,578,191 | 5/1971 | Horsch | 414/708 |
| 3,786,953 | 1/1974 | Crum et al. | 414/715 X |
| 4,029,226 | 6/1977 | Seaberg | 414/707 X |

*Primary Examiner*—John J. Love
*Assistant Examiner*—Terrance L. Siemens
*Attorney, Agent, or Firm*—Dressler, Goldsmith, Shore, Sutker & Milnamow, Ltd.

[57] ABSTRACT

A linkage system for automatically maintaining the orientation of a bucket of a tractor loader while the lift arms are moved between raised and lowered positions is disclosed herein. Several specific embodiments are illustrated and described in detail. Each embodiment incorporates one or more links joined to the lift arms in such a manner that a portion of that linkage is maintained generally parallel to the bucket end of the lift arm. By maintaining this parallel relationship throughout the rotation of the lift arm, the bucket positioning mechanism is displaced in such a manner as to counteract the rotation of the bucket induced by the motion of the lift arms alone. The automatic self-leveling feature improves the overall productivity of the tractor loader.

3 Claims, 9 Drawing Figures

SELF-LEVELING BUCKET LINKAGE

TECHNICAL FIELD

This invention relates to material-handling equipment and, particularly, to a loader assembly secured to a prime mover such as a tractor that includes a pivotally mounted bucket disposed across the front end of the tractor.

BACKGROUND OF THE INVENTION

Material-handling equipment, generally referred to as a "tractor loader" or "front-end loader," is one in which the bucket is disposed across the front end. The bucket is usually loaded by moving the bucket into a pile of material after which lift arms are raised and the tractor driven to a new location. At this point, the bucket is swung about the front end of lift arms into a dumping position to discharge the contents, after which the tractor is driven back for another load.

For the most part, loaders are essentially manually controlled devices, which is to say that the manipulation of the bucket through its various positions depends entirely upon the control of the operator. Thus, the operator must move and maintain the bucket level during the movement thereof between the loading and the dumping position. In addition, the operator has to see that the bucket is returned to the digging position before the tractor can be moved to receive another load. Simple as the task may be, this re-positioning of the bucket between each load places a burden on the operator, substantially reducing the speed at which the operator and the machine could perform and, thus, the amount of material that can be moved over any given period of time. Furthermore, the task is fatiguing and unnecessarily requires the operator to devote this attention to what is otherwise a repetitive or routine evolution not requiring special skill.

The tendency for a bucket to spill its contents when manipulated from a lowered to a raised position is due to the characteristic arcuate movement of the lift arms and the bucket. During the raising movement, the bucket is tilted more and more backwardly towards the tractor wherein the material is spilled over the rear edge. This spillage of material is a potential hazard to the operator. In addition, it unnecessarily reduces the effective amount of material moved with each load. Thus, it can be appreciated that any apparatus which would automatically level the bucket during lifting operation, would free the operator to concentrate on driving the tractor and moving the payload at the maximum speed while filling the bucket to its greatest loading capacity.

While various devices have been proposed to maintain the bucket level, many of the devices known to those skilled in the art are extremely complicated in nature and are expensive to incorporate or backfit into the design of the loader. One typical linkage mechanism is shown in the tractor loader invented by Steinkampf (U.S. Pat. No. 3,447,708). Others have incorporated automatic hydraulic circuits to achieve the self-leveling function; Hough (U.S. Pat. No. 2,782,946) is an example of this latter group.

SUMMARY OF THE INVENTION

In accordance with the present invention, there is provided a loader mechanism which incorporates a novel yet highly efficient self-leveling mechanism that will hold the bucket in a substantially fixed orientation while being raised and lowered by the lift arms. In this way, spillage of the load over the back wall or spill wall of the bucket during the lifting movement is greatly reduced. Specifically, a sliding linkage is provided to support the bucket tilt cylinders. One end of the sliding linkage is pivotally linked to the tractor. The sliding linkage is maintained parallel to the bucket end of the lift arms. As the lift arms are raised, the sliding linkage moves forwardly to reposition the bucket tilt cylinders. This forward sliding action compensates for the increased bucket angle due to the raising of the lift arms alone. Several specific embodiments are disclosed. Two embodiments use a pair of articulated linkages joining the lift arm and the tilt cylinders. In another embodiment, a generally U-shaped channel member is pivoted to the tractor at one end and is free to slide along a complementary portion on the bucket end of the lift arm. In still another embodiment, a generally L-shaped channel is pivotally connected to the tractor at one end and slidably joined to the lift arms by a pin and slot arrangement, the slot being in the L-shaped channel member and the pin being joined to the lift arm. In another embodiment, a bracket formed from two generally U-shaped channel members fits over a complementary portion at the bucket end of the lift arm. One end of the bracket is pivotally connected to the hydraulic actuator used to raise and lower the lift arms.

Regardless of the specific embodiment used, the sliding linkage allows the loader operator to move the bucket in a generally level condition between raised and lowered positions of the lift arms, thereby improving the productivity of the operator and improving the utilization of the loader. Numerous other advantages and features of the present invention will become readily apparent from the following detailed description of the invention and of the embodiments illustrated therein, from the claims and from the accompanying drawings.

DETAILED DESCRIPTION

Figure 1:
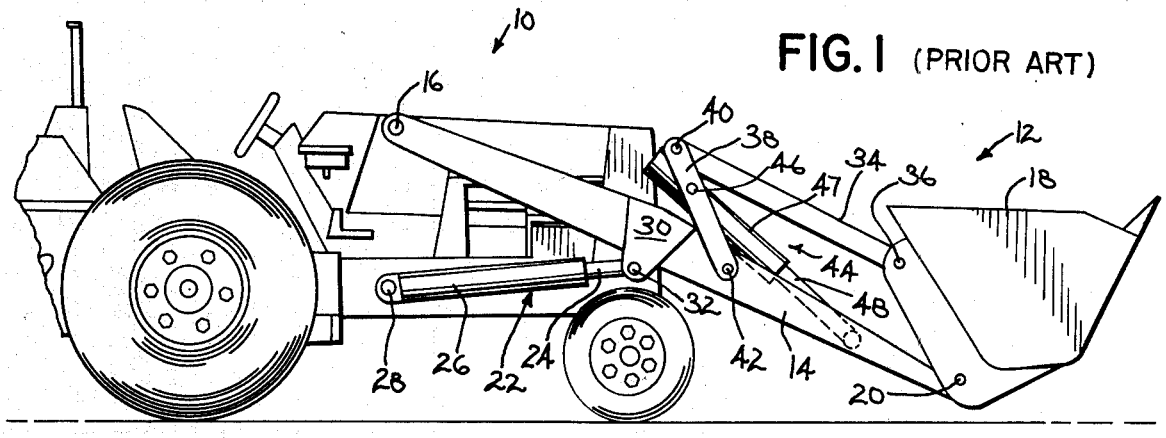
FIG. 1 (PRIOR ART)
FIG. 1 is a right side, elevational view of an ordinary tractor-loader.

While this invention is susceptible of embodiment in many different forms, there is shown in the drawings, and will herein be described in detail, specific embodiments with the understanding that the present disclosure is to be considered as an exemplification of the principles of the invention and is not intended to limit the invention to the specific embodiments illustrated.

Referring to the drawings, FIG. 1 is a elevational view of the right side of a tractor 10 on which has been mounted at the front end thereof a loader mechanism 12. The tractor 10 provides a support frame and a source of hydraulic power to operate the loader mechanism 12. The components of the loader mechanism 12 are essentially duplicated on either side of the tractor 10; for this reason, only those components on the right side of the tractor 10 will be described in detail with the understanding that the description will likewise refer to an identical set of components located on the left side of the tractor 10.

As illustrated in FIG. 1, the loader mechanism 12 includes a lift arm 14 pivotally connected at one end to the tractor frame by pivot pin 16 and pivotally connected at the opposite end to the bucket 18 by pivot pin 20. The lift arm 14 is pivoted about pin 16 on the tractor 10 by the operation of a hydraulic actuator (hereinafter alternately referred to as the "lift arm actuator") 22 through the extension or retraction of a piston rod 24 extending outwardly from a hydraulic cylinder 26. As shown in the drawings, the cylinder portion of the hydraulic actuator 22 is pivoted at one end to the tractor frame by a pivot pin 28. The other end of the piston rod 24 is disposed between and pivotally connected by a pivot pin 32 to a pair of downwardly extending reinforcing plates 30 that are secured to an intermediate portion of the lift arm 14. Thus, it can be seen that when pressure is applied to the lefthand end of the cylinder 26, the lift arm 14 will be rotated in a counterclockwise direction about pivot pin 16 to raise the bucket 18. Conversely, when fluid is supplied to the righthand end of the cylinder 26, the lift arms will be rotated in the clockwise direction to lower the bucket 18.

The positioning of the bucket 18 relative to the lift arm 14 is accomplished by a hydraulically operated bucket positioning mechanism. The hydraulically operated bucket positioning mechanism joins the bucket 18 with the lift arm 14. Depending upon the size of the bucket 18 and the load, the bucket positioning mechanism can consist of two otherwise identical mechanisms on either side of the tractor or a single mechanism on one side of the tractor. The bucket positioning mechanism consists of a first link 34 joined to the bucket 18 at one end by a pivot pin 36 and at the opposite end a second link 38 by a pivot pin 40. The opposite end of the second link 38 is pivotally connected to the lift arm 14 by a pivot pin 42. Typically, the second link 38 is a pair of links joined to either side of the lift arm 14. It thus can be seen that pivotal movement of the second link 38 about pivot pin 42 joined to the lift arm 14 will pivot the bucket 18 in the same direction about the end of the lift arm 14.

To effectuate movement of the first link 34 and the second link 38, and the bucket 18, a bucket tilt cylinder (a hydraulic actuator) 44 is pivotally connected to an intermediate portion of the second link 38 by a pivotal connection 46 which comprises a trunion-type support for the hydraulic actuator 44 (hereinafter, alternatively referred to as the "bucket actuator"). The piston rod portion 48 of the bucket actuator 44 extends forwardly towards the lift arm 14 and is pivotally connected at its end to the lift arm. It should be appreciated that the bucket actuator 44 can be positioned with the piston rod 48 joined either to the lift arm 14 or to the second link 38. In other words, reversing the position of the cylinder portion 47 of the bucket actuator 44 with the piston rod portion 48 will not affect the operation of the bucket positioning mechanism. For convenience and simplicity, the forward end of the piston rod 48 is joined to the lift arm 14 using the same pivot pin 20 joining the bucket 18 to the lift arm 14. Thus, the introduction of pressurized fluid to one end of the bucket actuator 44 and the corresponding withdrawal of fluid from the other end will result in axial movement of the bucket actuator which will cause the pivotal movement of the first link 34 and the second link 38 and corresponding pivotal movement of the bucket 18. It is, of course, understood that if two bucket actuators are used, they are operated simultaneously to bring about the desired result. The particular details of the hydraulic system used to operate such a loader mechanism as has been just described should be well-known to those skilled in the art. The loader described by E. B. Long in U.S. Pat. No. 3,220,580 and assigned to the assignee of the present invention is incorporated by reference insofar as it describes the details of a typical hydraulic system used to operate the loader mechanism 12.

As can be appreciated from the foregoing description and by studying FIG. 1, if the lift arm 14 is pivoted counterclockwise, the bucket 18 is moved from a lowered to a raised position. However, unless the bucket actuator 44 is operated to pivot the bucket clockwise, the orientation of the bucket 18 relative to the tractor 10 will pivot or rotate counterclockwise just as the lift arm 14.

Figure 2:
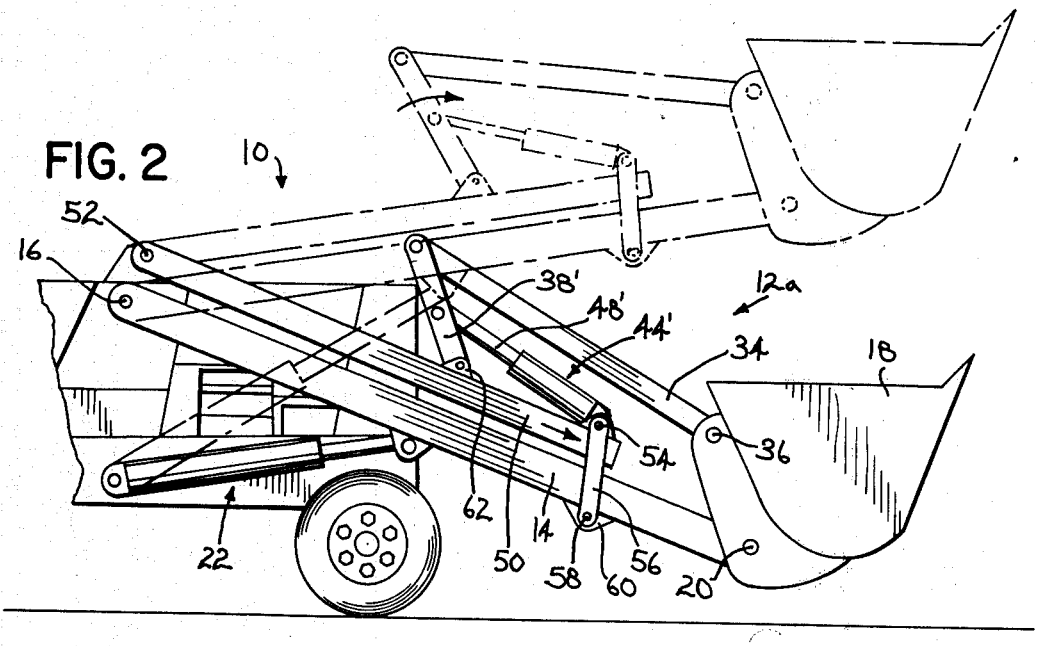
FIG. 2 is a partial, elevational view of the tractor-loader shown in FIG. 1 incorporating one embodiment of the present invention and illustrating the bucket in lowered and in raised positions.

FIG. 2 illustrates a loader mechanism **12*a* that incorporates a "self-leveling feature". As explained above, as the lift arm 14 is pivoted to rotate the bucket 18 counterclockwise, the bucket will also pivot counterclockwise unless bucket actuator 44 is operated to pivot the bucket 18 clockwise a corresponding amount. The loader mechanism 12*a* shown in FIG. 2 automatically rotates the bucket 18 clockwise when the lift arm 14 is rotated counterclockwise, thus maintaining the bucket 18 in an essentially level condition. The specific loader mechanism 12*a* includes a third link 50 extending generally the same direction as the lift arm 14. One end of the third link 50 is pivotally connected to the tractor 10 by a pivot pin 52. The opposite end of the third link is pivotally connected by a pin 54 to a fourth link 56. The opposite end of the fourth link 56 is pivoted by a pivot pin 58 to a bracket 60 joined to the bucket end of the lift arm 14. For generality, the bucket actuator 44' is positioned oppositely that shown in FIG. 1. The second link 38, instead of being pivotally connected to the lift arm 14, is pivotally connected to a bracket 62 intermediate the ends of the third link 50. With these exceptions, the loader mechanism 12*a* is otherwise identical to and operates the same as the loader mechanism 12** shown in FIG. 1.

As the lift arm actuator 22 is operated to rotate the lift arm 14 in the counterclockwise direction, the third link 50 is also rotated counterclockwise by virtue of the fourth link 56 pivotally connecting the third link 50 with the lift arm 14. Shown in phantom in FIG. 2, is the position of the components of the loader mechanism 12' in a raised position. Inasmuch as the third link 50 is rigid, the raising of the lift arm 14 forces the third link 50 to maintain its position generally parallel to the lift arm 14 while at the same time moving forwardly towards the bucket 18. The forward movement of the third link 50 effectively operates as if the bucket actuator 44' itself were operated so as to drive the piston rod portion 48' inwardly. As discussed above, in relation to the bucket actuator 44' in FIG. 1, the inward movement or contraction of the bucket actuator 44' rotates the second link 38 clockwise which in turn rotates the bucket 18 clockwise. Thus, the counterclockwise rotation of the bucket 18 produced by the raising of the lift arm 14 is "counteracted" by the clockwise rotation of the bucket 18 induced by the forward movement of the third link 50. Therefore, the bucket 18 is kept essentially in the same relative orientation while it is moved between lowered and raised positions.

Figure 3:
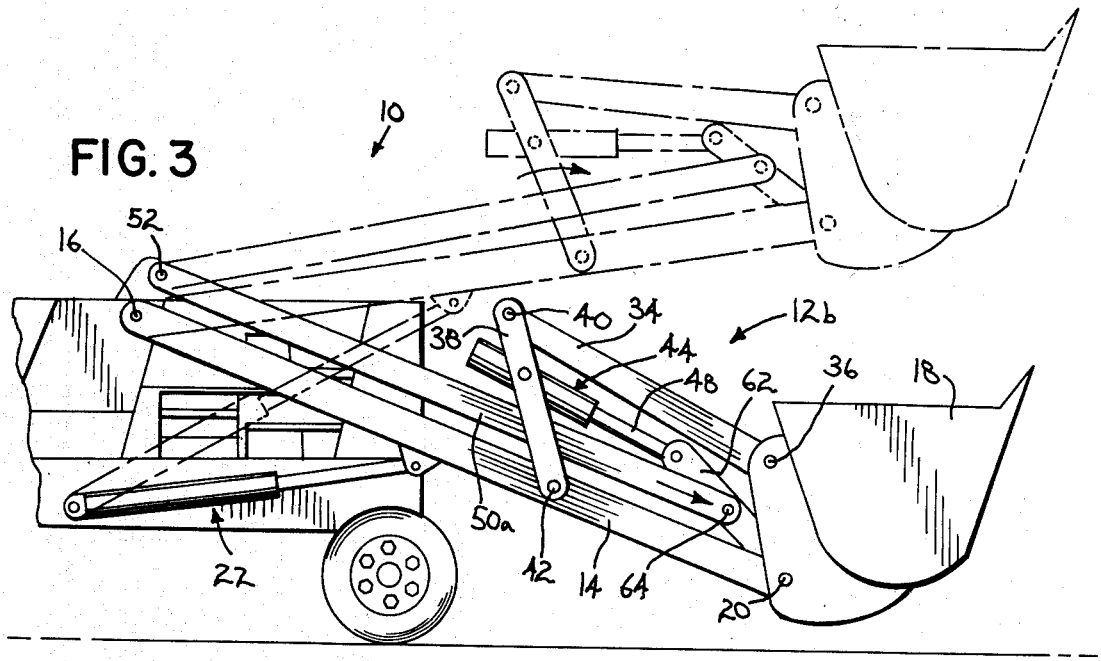
FIG. 3 is a partial, elevational view of the tractor-loader shown in FIG. 1 incorporating a second embodiment of the present invention and illustrating the bucket in lowered and in raised positions.

FIG. 3 is another embodiment of a loader mechanism **12*b* used to position the bucket 18. Just as in FIG. 2, a third link 50*a* extends generally parallel to the lift arm 14. The third link 50*a* is pivoted at one end by a pin 52 to the tractor 10. The opposite end of the third link 50*a* is pivoted to a fifth link 62 by a pivot pin 64 at a point intermediate the ends of the fifth link. One end of the fifth link 62 is pivotally connected to the pivot pin 20 joining the bucket end of the lift arm with the bucket 18. The opposite end of the fifth link 62 is pivotally connected to the piston rod portion 48 of the bucket actuator 44. The remaining components of the bucket positioning mechanism is the same as shown in FIG. 1**.

Just as in the case of the loader mechanism illustrated in FIG. 2, as the lift arm 14 is rotated by the lift arm actuator 22 in a counterclockwise direction, the bucket 18 is also rotated counterclockwise. However, by virtue of the fifth link 62, the third link **50*a* rotates counterclockwise and at the same time translates or shifts forwardly in a direction of the bucket 18. The position of the components of the loader mechanism 12*b* when in a raised position is shown in phantom in FIG. 3. The forward translation of the third link 50*a* effectively draws the bucket actuator 44 forwardly in the direction of the bucket 18. This forward motion of the bucket actuator 44 is equivalent to contraction of the piston rod portion 48 of the bucket actuator 44 shown in FIG. 1. This, of course, resulted in the bucket 18 rotating clockwise. Thus, the loader mechanism 12*b* shown in FIG. 3** effectively operates to maintain the bucket in the same relative orientation when moving between lowered and raised positions.

Figure 4:
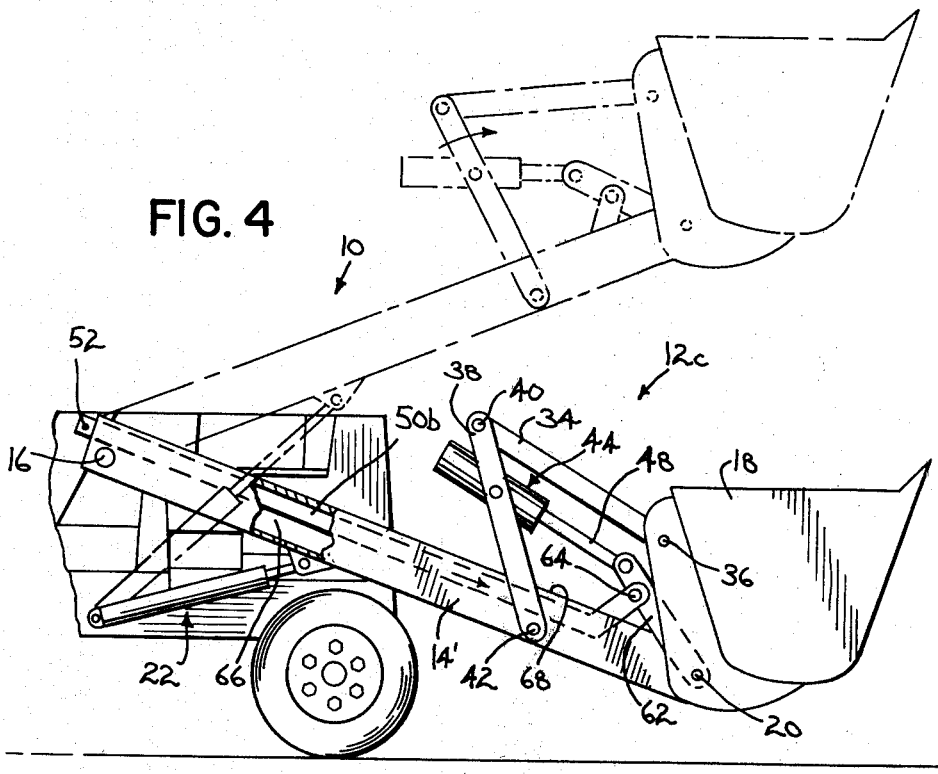
FIG. 4 is a modified version of the embodiment shown in FIG. 3.

FIG. 4 is a modified version of the loader mechanism **12*b* shown in FIG. 3. The principle difference is that the lift arm 14' in FIG. 4 is a hollow box girder 66. The third link 50*b*, instead of being positioned above and generally parallel to the lift arm is positioned or housed within the hollow lift arm 14'. The bucket end of the lift arm 14' is slotted to provide an opening 68 for the bucket end of the third link 50*b*. The opening 68 is sufficiently large to allow the third link 50*b* to articulate without interference from the lift arm 14'. The components of the loader mechanism 12*c* are otherwise identical to the components of the loader mechanism 12*b* illustrated in FIG. 3. Moreover, the loader mechanism 12*c* operates identically to the loader mechanism 12*b* illustrated in FIG. 3. FIG. 4 illustrates in phantom the position of the components of the loader mechanism 12*c* with the bucket moved to a raised position. Housing the third link 50*b* inside of the lift arm 14' improves the overall appearance of the loader mechanism and in addition reduces the likelihood of objects being interposed between the lift arm 14' and the third link 50*b* which could interfere with the operation of the loader mechanism 12*c***.

Figure 5A:
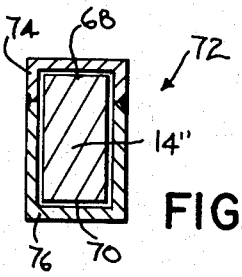
FIG. 5A is a cross-sectional view of the lift arms illustrated in FIG. 5 as viewed along line 5A—5A.
Figure 5:
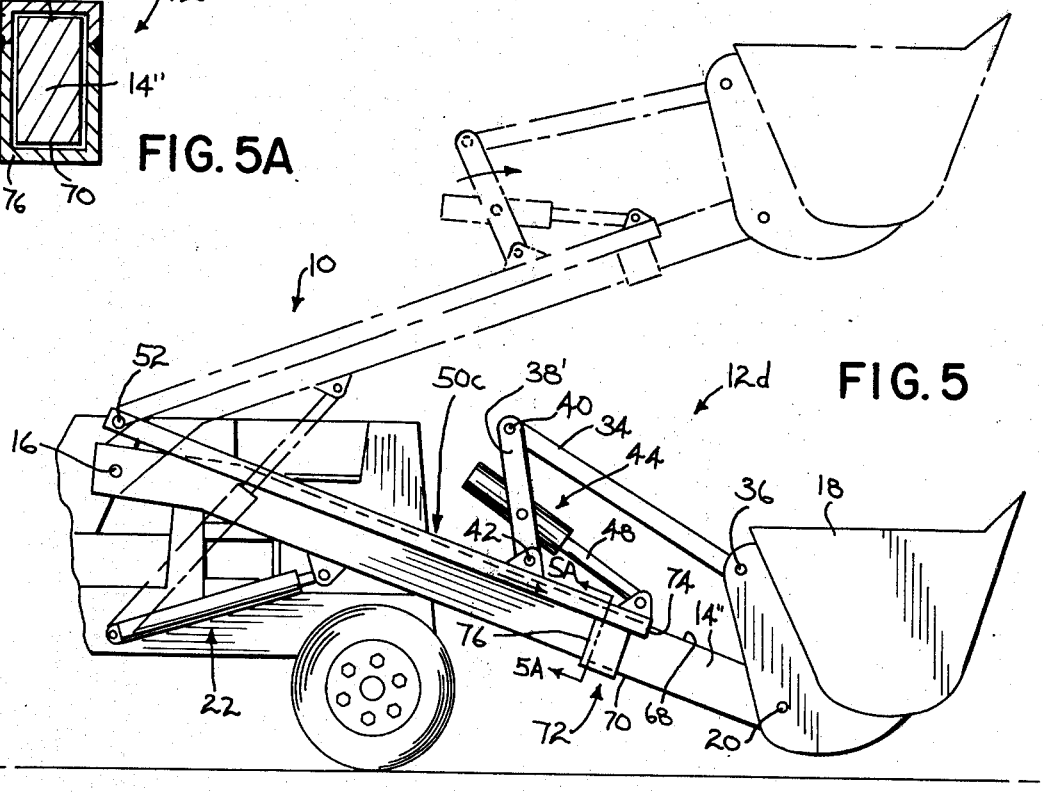
FIG. 5 is a partial, elevational view of the tractor-loader shown in FIG. 1 incorporating a third embodiment of the present invention and illustrating the bucket in lowered and in raised positions.

FIG. 5 illustrates still another embodiment of a loader mechanism **12*d* incorporating a self-leveling feature. Just as in the previous embodiments the third link 50*c* is pivoted at one end to the tractor 10 by a pivot pin 52. Here, however, the bucket end of the lift arm 14*b* and the bucket end of the third link 50*c* are complementary and interlocking. Specifically, the bucket end of the lift arm 14'' defines a generally rectangular cross section having two parallel edges or surfaces 68, 70. The bucket end of the third link 50*c* incorporates a bracket 72 that is complementary to the two parallel surfaces 68, 70 of lift arm 14''. As illustrated in FIG. 5A, the bracket 72 is formed from two U-shaped members 74, 76. One U-shaped member 74 is an elongated piece of U-shaped channel stock. This member 74 essentially forms the "main body" portion of the third link 50*c*. A substantially shorter piece of U-shaped channel stock 76 forms the second U-shaped member forming the bracket 72. Welding or bolting can be used to join together the two U-shaped members 74, 76**.

Thus, by virtue of the complementary interlocking relationship between the third link **50*c* and the bucket end of the lift arm 14'', the counterclockwise rotation of the lift arm forces the bucket end of the third link 50*c* to move along the two parallel surfaces 68, 70 of the lift arm 14*b* and in the direction of the bucket 18. Much as the case illustrated in FIG. 2, this drives the bucket actuator 44 forwardly in the direction of the bucket which is equivalent to rotating the bucket clockwise. The clockwise rotation of the bucket compensates for the counterclockwise rotation of the bucket brought about by the lift arms alone and thus the bucket 18 remains essentially in the same orientation. The relative position of the components of the loader mechanism 12*d* when in a raised position is illustrated in phantom in FIG. 5**.

Figure 6:
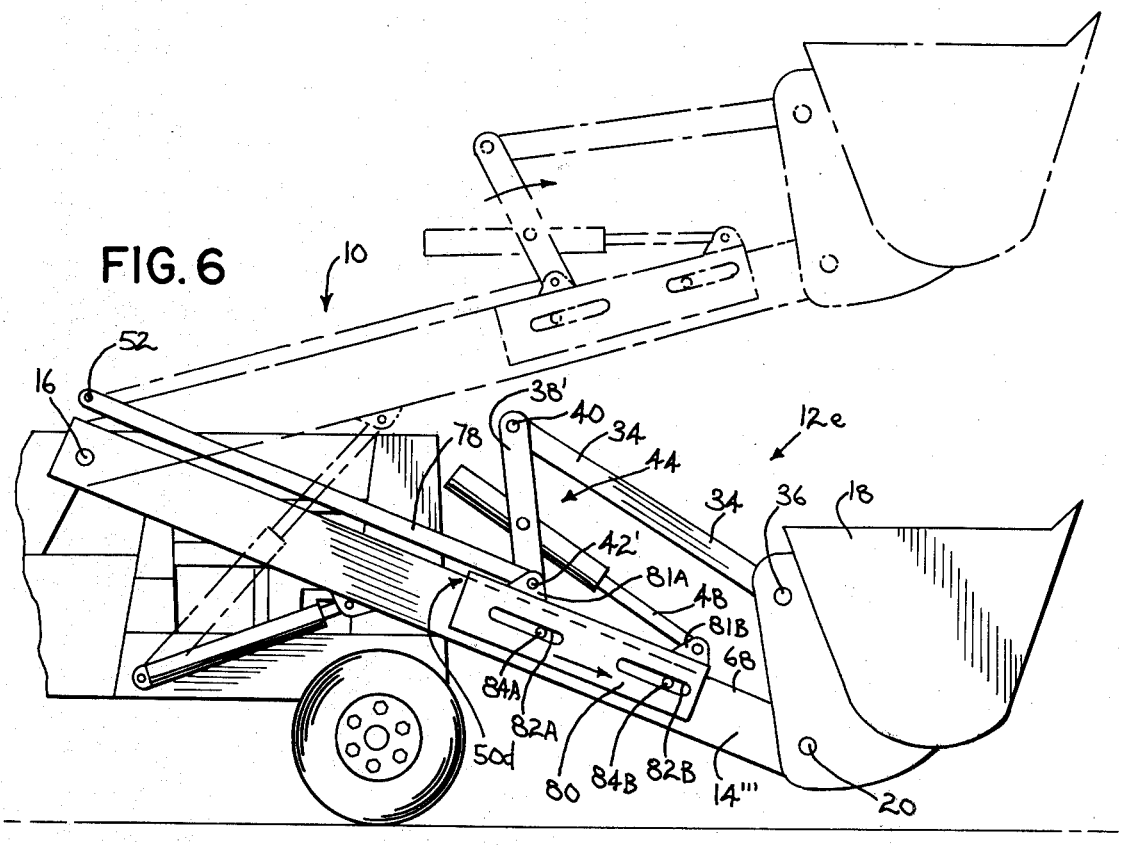
FIG. 6 is a partial, elevational view of the tractor-loader shown in FIG. 1 incorporating a fourth embodiment of the present invention and illustrating the bucket in lowered and in raised positions.

FIG. 6 is another embodiment of a self-leveling loader mechanism **12*e*. This loader mechanism 12*e* incorporates many of the essential components in FIG. 5. Here, the third link 50*d* is formed from two articulated members: a sixth link 78 and an L-shaped bracket 80. One end of the sixth link is pivoted by a pin 52 of the tractor 10. The opposite end of the sixth link is pivotally connected by a pin 42' to the L-shaped bracket 80. The pin 42' joining the sixth link 78 with the L-shaped bracket 80 also joins the second link 38' to the third link 50*d***.

The L-shaped bracket 80 is formed from a relatively short piece of L-shaped channel stock. The L-shaped bracket 80 is complementary to and interlocks with the bucket end of the lift arm 14'''. Specifically, the bucket end of the lift arm 14''' defines a generally flat upper surface 68 which supports one leg (here the upper leg) of the L-shaped bracket 80. This allows the L-shaped bracket 80 to freely slide along the bucket end of the lift arm **14*c***.

The upper leg of the L-shaped bracket 80 includes two lugs 81A, 81B used to pivotally connect the L-shaped bracket 80 with the sixth link 78 on one hand, and the second link 38' and the piston rod end 48 of the bucket actuator 44' on the other hand. The other leg of the L-shaped bracket 80 defines two generally rectangular parallel slots 82A and 82B. The corresponding portion of the bucket end of the lift arm 14''' defines two studs 84A and 84B. These two studs 84A, 84B cooperating with the slots 82A, 82B in the L-shaped bracket 80 guide the third link **50*d* in such a manner that the bucket end of the third link 50*d* moves parallel to the bucket end of the lift arm 14'''. It should be understood, of course, that the parallel motion of the L-shaped bracket 80 portion of the third link 50*d* relative to the bucket end of the lift arm 14''' is effectively provided by the parallel relationship between the two slots 82A and 82B. In other words, the upper leg of the L-shaped bracket 80 need not cooperate with the upper surface 68 of the lift arm 14''' in order to achieve this parallel moving relationship between the bucket end of the lift arm 14''' and the bucket end of the third link 50*d*. However, by having the upper leg of the L-shaped bracket 80 slide along the upper surface 68 of the lift arm 14''', the static and dynamic forces resulting from the operation of the bucket positioning mechanism are taken up by the broad or relatively larger surfaces of the lift arm 14''' rather than by the two studs 84A, 84B**.

FIG. 6 illustrates the preferred arrangement of the components of this embodiment. Shown in phantom in FIG. 6 is the position of the loader mechanism **12*e* with the bucket 18 in a raised position. Just as in the cases previously described, when the lift arm rotates counterclockwise, the bucket is rotated counterclockwise. However, because the third link 50*d* is interlocked with the bucket end of the lift arm 14''', the L-shaped bracket 80 is forced to move parallel to the lift arm and in the direction of the bucket 18. The forward motion of the third link, just as in the cases previously described, is effectively the same as if bucket actuator 44 in the loader mechanism 12 illustrated in FIG. 1 were to contract and thus rotate the bucket 18** clockwise. Thus, the effective clockwise rotation of the bucket counteracts the counterclockwise movement of the bucket induced by the lift arms and the bucket remains in essentially the same configuration when moved between lowered and raised positions.

Figure 7A:
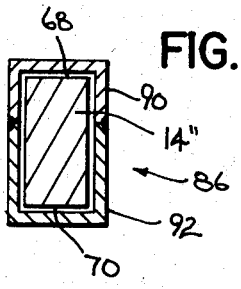
FIG. 7A is a cross-sectional view of the lift arms illustrated in FIG. 7 as viewed along line 7A–7A.
Figure 7:
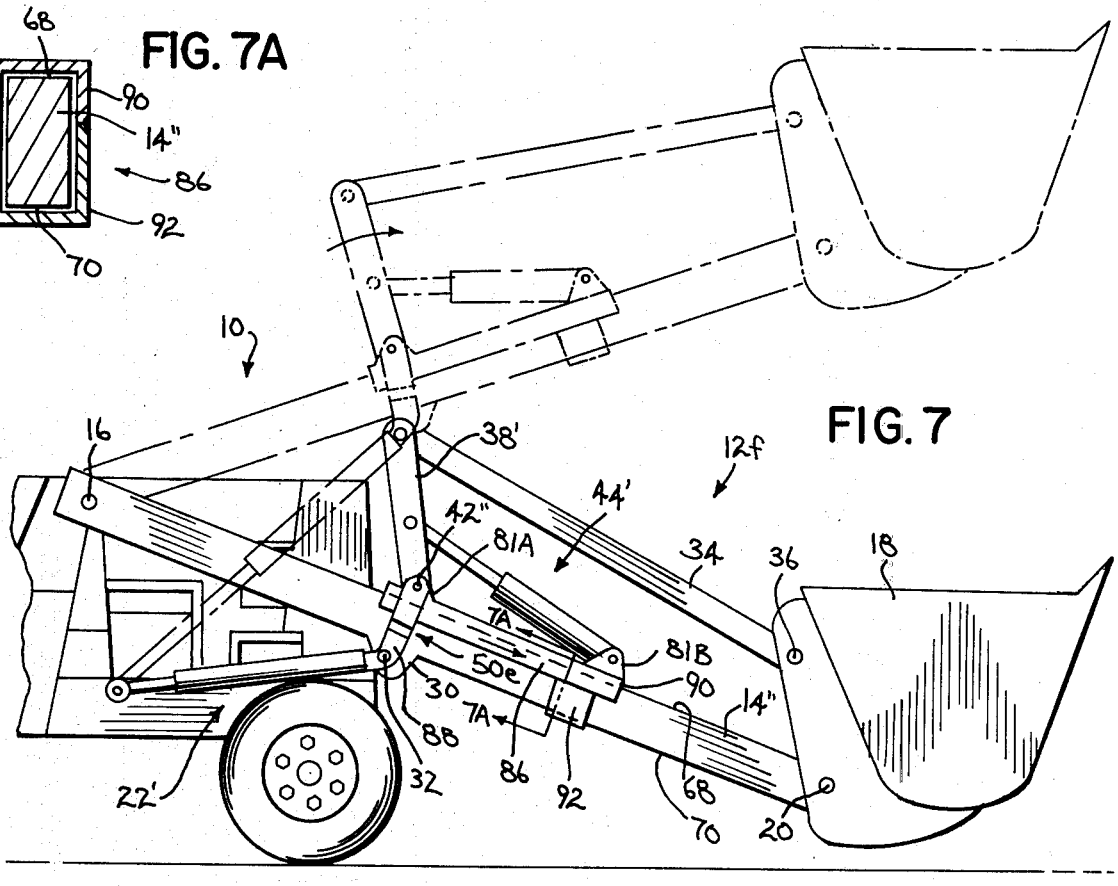
FIG. 7 is a partial, elevational view of the tractor-loader shown in FIG. 1 incorporating a fifth embodiment of the present invention and illustrating the bucket in lowered and in raised positions.

FIG. 7 illustrates the final embodiment of a self-leveling loader mechanism **12*f*. This particular embodiment effectively incorporates the complementary interlocking relationship between the third link 50*c* and the lift arm 14*b* used in the embodiment illustrated in FIG. 5 with the two-piece third link 50*d* used in the embodiment illustrated in FIG. 6. Specifically, the third link 50*e* is formed from two members: a sliding channel member 86 and an integral extension of the lug 88 joining the lift arm actuator 22' with the lift arm 14''. The bucket end of the lift arm 14'' defines two generally parallel surfaces 68, 70. The sliding channel member 86 is complementary to the two parallel surfaces 68, 70 of the lift arm 14''. As shown in FIG. 7A, the sliding channel member 86 is fabricated from two U-shaped members 90, 92** formed from U-shaped channel stock and joined leg to leg by welding or mechanical fasteners.

As shown in FIG. 7, one U-shaped member, the upper member 90, rests atop the upper surface 68 of the lift arm 14''. The upper U-shaped channel member 90 is much longer in length than the lower U-shaped member 92 since the upper member bears the forces generated by the bucket positioning mechanism. The lower U-shaped member 92 acts primarily as a guide and cooperates with the lower parallel surface 70 of the lift arm 14b to direct the U-shaped channel member 86 slidingly along the bucket end of the lift arm. The upper U-shaped member 90 forms a base for two lugs 81A and 81B. These two lugs 84A, 84B function in the same manner as the lugs for the loader mechanism **12*e* shown in FIG. 6. For purposes of generality, the relative positions of the cylinder portion and the piston rod portion of the bucket actuator 44' shown in FIG. 6** have been reversed. As previously described, the operation of the bucket positioning mechanism is not otherwise affected by this reversal.

The second part of the third link **50*e* is the integral extension of the lug 88 joining the lift arm actuator 22' with the lift arm 14''. Just as in the embodiment illustrated in FIG. 2, the lift arm actuator 22' is pivotally connected to a reinforcing plate or lug 30 joined to the lift arm 14'' by a pivot pin 32. Here, however, the bracket or lug 88 joining the lift arm actuator 22' with the lift arm 14'' is "extended" transversely to the longitudinal axis of the lift arm 14'' where a pivot pin 42'' joins the lug with the sliding channel member 86 and the second link 38'. The lug 88 functions much as the fourth link 56 shown in FIG. 2 or the fifth link 62 shown in FIG. 3. In other words, the lug 88 by virtue of being pivotally connected at one end to the lift arm 14'' and at the other end to the sliding channel member 86, drives the channel member towards and away from the bucket 18. FIG. 7 illustrates in phantom the relative position of the components of the loader mechanism 12*f* with the bucket in a raised position. Thus, when the lift arm actuator 22' is operated to rotate the lift arm 14'' counterclockwise the lug 88 forces the sliding channel member 86 in the direction of the bucket since the channel member is complementary to the two parallel surfaces 68, 70 of the bucket end of the lift arm 14''. This displaces the first link 34 and the second link 38' which effectively rotates the bucket clockwise which counteracts the counterclockwise rotation of the bucket induced by the counterclockwise rotation of the lift arm 14'' alone. Consequently, the relative orientation of the bucket 18** is maintained essentially the same when repositioned between lowered and raised positions.

Thus, six specific embodiments of a loader mechanism have been illustrated and described in detail. Each embodiment functions to self-level the bucket as the bucket that has been rotated to the "rolled back" position is moved between raised and lowered positions. Since the leveling of the bucket is achieved simultaneous with the raising and lowering of the bucket, the operator of the tractor loader need not concern himself with maintaining his bucket in a level position. By keeping the rolled back bucket level the contents of the bucket are kept from spilling outside the bucket. The overall productivity of the operator and his machine is consequently improved over that of loaders not having a self-leveling feature. All of the embodiments produce essentially the same effect. The specific embodiment selected for a particular application is largely dependent upon the overall configuration and specific arrangement of the tractor loader to which the apparatus is to be attached.

Thus, it is apparent that there has been provided in accordance with the invention a wide variety of linkage arrangements that produce self-leveling of a bucket in a tractor loader. While the invention has been described in conjunction with several specific embodiments, it is evident that many alternatives, modifications, and variations will be apparent to those skilled in the art in light of the foregoing detailed description. Accordingly, it is intended to cover all such alternatives, modifications, and variations as set forth within the spirit and broad scope of the appended claims.

What is claimed is as follows:

1. A self-leveling loader, comprising:

(a) a frame;

(b) a material handling implement disposed at the front end of said frame;

(c) a lift arm pivoted at one end to said frame and pivoted at the opposite end to said implement, that end of said lift arm pivoted to said implement defining the implement end of said lift arm;

(d) first extensible means, joining said frame and said lift arm, for raising and lowering said implement relative to said frame;

(e) tilting means, carried by said lift arm and coupled to said implement, for rotating said implement about said lift arm between a dumped position and a rolled back position;

(f) driven means, carried by said lift arm and operatively associated with said first extensible means, for moving said tilting means along the implement end of said lift arm simultaneously with the rotation of said lift arm whereby said implement is maintained generally at the same orientation relative to said frame while said lift arm is rotated between raised and lowered positions by said first extensible means said driven means including a first link having one end operatively connected to said tilting means and having the other end pivotally connected to said frame, said tilting means including a second link having one end pivotally connected to said lift arm intermediate the ends thereof, the other end of said second link being pivotally connected to one end of a third link, the other end of the third link being pivotally connected to said implement, said tilting means further including a fifth link having one end pivotally connected to the implement end of said lift arm, and a fourth extensible link pivotally connected intermediate the ends of said second link and extending therefrom to the other end of said fifth link, the one end of said first link being pivotally connected to said fifth link intermediate the ends thereof.

2. The self-leveling loader in accordance with claim 1, wherein said first extensible means comprises a hydraulic fluid actuator.

3. The self-leveling loader in accordance with claim 2, wherein said extensible link comprises another hydraulic fluid actuator.

* * * * *